US009437970B2

(12) United States Patent
Quero Pacheco et al.

(10) Patent No.: US 9,437,970 B2
(45) Date of Patent: Sep. 6, 2016

(54) MULTI-POLE PLUG CONNECTION UNIT FOR THREE-PHASE ALTERNATING CURRENT SYSTEMS

(71) Applicants: José Quero Pacheco, Bietigheim-Bissingen (DE); Marcin Moscicki, Besigheim (DE); Steffen Lentmaier, Grossbottwar (DE)

(72) Inventors: José Quero Pacheco, Bietigheim-Bissingen (DE); Marcin Moscicki, Besigheim (DE); Steffen Lentmaier, Grossbottwar (DE)

(73) Assignee: LQ MECHATRONIK-SYSTEME GMBH, Freiberg am Neckar (DE)

( * ) Notice: Subject to any disclaimer, the term of this patent is extended or adjusted under 35 U.S.C. 154(b) by 70 days.

(21) Appl. No.: 14/357,104

(22) PCT Filed: Nov. 8, 2012

(86) PCT No.: PCT/EP2012/072200

§ 371 (c)(1),
(2) Date: May 8, 2014

(87) PCT Pub. No.: WO2013/068509

PCT Pub. Date: May 16, 2013

(65) Prior Publication Data

US 2014/0295690 A1 Oct. 2, 2014

(30) Foreign Application Priority Data

Nov. 9, 2011 (DE) ..... 10 2011 086 045
Mar. 5, 2012 (DE) ..... 10 2012 203 459

(51) Int. Cl.
*H01R 13/52* (2006.01)
*H01R 13/625* (2006.01)
*H01R 13/56* (2006.01)

(52) U.S. Cl.
CPC ..... *H01R 13/625* (2013.01); *H01R 13/521* (2013.01); *H01R 13/56* (2013.01); *H01R 13/562* (2013.01)

(58) Field of Classification Search
CPC ... H01R 13/62; H01R 13/622; H01R 13/625
USPC ..... 439/320, 271
See application file for complete search history.

(56) References Cited

U.S. PATENT DOCUMENTS 5,100,341 A 3/1992 Czyz et al.
7,150,424 B2 * 12/2006 Hopper ..... B25H 1/0028 242/375.1

(Continued)

FOREIGN PATENT DOCUMENTS

DE 299 10 960 U1 12/1999
DE 100 34 502 A1 1/2002

(Continued)

OTHER PUBLICATIONS

Form PCT/ISA/210 issued in International Application No. PCT/EP2012/072200 with English translation with a mailing date of Feb. 14, 2013 (4 pages).

(Continued)

*Primary Examiner* — Abdullah Riyami
*Assistant Examiner* — Nader Alhawamdeh
(74) *Attorney, Agent, or Firm* — Flynn, Thiel, Boutell & Tanis, P.C.

(57) ABSTRACT

A multi-pole plug connection unit for three-phase alternating current systems having two plug connection parts which complement one another for the purpose of kink-free plug connection and having a locking sleeve which axially secures the plug connection parts in relation to one another in the plug-connected state is known. Each plug connection part is constructed as a monolithic insulating body in which a plurality of electrical plug contacts are axially latched, and an outside diameter of the plug connection parts and the locking sleeve is less than 23 mm, and the plug connection unit is designed to transmit voltage and current intensity ranges of up to 630 volts/16 amperes. The multi-pole plug connection unit is used for energy and signal transmission in machine tools.

21 Claims, 10 Drawing Sheets

(56) References Cited

U.S. PATENT DOCUMENTS

| | | | | |
|---|---|---|---|---|
| 7,824,204 | B2 * | 11/2010 | Fujiwara | H01R 13/5219 439/311 |
| 8,007,302 | B2 | 8/2011 | Kleinke | |
| 8,317,531 | B2 | 11/2012 | Kleinke | |
| 8,974,243 | B2 * | 3/2015 | Friese | H01R 13/4367 439/374 |
| 2005/0051406 | A1 | 3/2005 | Hopper | |
| 2008/0207040 | A1 * | 8/2008 | Eissner | H01R 13/6277 439/372 |
| 2009/0269958 | A1 * | 10/2009 | Fujiwara | H01R 13/5219 439/320 |
| 2009/0311910 | A1 * | 12/2009 | Kleinke | H01R 9/03 439/607.51 |
| 2011/0300732 | A1 | 12/2011 | Kleinke | |

FOREIGN PATENT DOCUMENTS

| | | | | |
|---|---|---|---|---|
| DE | 100 34 502 | C2 | 1/2002 | |
| DE | 10 2006 025 134 | A1 | 12/2007 | |
| DE | EP 1936752 | A2 * | 6/2008 | H01R 13/625 |
| EP | 1 936 752 | A2 | 6/2008 | |

OTHER PUBLICATIONS

First Office Action of Chinese Patent Office issued in Application No. 201280066511.2 with English translation, date of issue Dec. 3, 2015 (13 pages).

* cited by examiner

MULTI-POLE PLUG CONNECTION UNIT FOR THREE-PHASE ALTERNATING CURRENT SYSTEMS

FIELD OF THE INVENTION

The invention relates to a multipole plug-type connection unit for three-phase AC systems comprising two plug-type connection parts which are complementary to one another for plugging one inside the other without bending and comprising a locking sleeve, which secures the plug-type connection parts axially against one another in the plugged-together state.

BACKGROUND OF THE INVENTION

Such a multipole plug-type connection unit is known from EP 1 936 752 A2. The known plug-type connection unit has two plug-type connection parts, which each have a multipart design and which can be locked against one another via a locking sleeve which likewise has a multipart design. Each plug-type connection part is provided with electrical plug-type contacts, which are configured as individual pins or as individual jacks. Both the individual pins and the individual jacks are integrated in insulating sleeves, which in turn merge with an insulating body consisting of plastics. The insulating body is inserted into a metallic hollow body, which is likewise part of the respective plug-type connection part.

SUMMARY OF THE INVENTION

The object of the invention is to provide a multipole plug-type connection unit of the type mentioned at the outset which can be produced at low cost and is in particular configured in miniaturized form and can preferably nevertheless transmit high voltage and current intensities.

This object is achieved by virtue of the fact that each plug-type connection part is designed as a monolithic insulating body, in which a plurality of electrical plug-type contacts are latched axially, that in particular an outer diameter of the plug-type connection parts and of the locking sleeve is less than 23 mm, and that, preferably, the plug-type connection unit is designed to transmit voltage and current intensity ranges of up to 630 volts/16 amperes (630 V/16 A). By virtue of the combination of these features, a miniaturized circular plug-type connection module is provided which can transmit high electrical voltages and current intensities. The solution according to the invention is particularly advantageously suitable for energy transmission between machine tools and control devices or switchgear cabinets.

In one configuration of the invention, the plug-type connection unit has a water-tight configuration in accordance with protection class IP65. As a result, a water-tight plug-type connection unit which can be subjected to correspondingly high levels of loading is provided.

In a further configuration of the invention, electrical cable wires of a cable having a wire cross section of 2.5 $mm^2$ are connected to the electrical plug-type contacts. Despite the miniaturization that has been performed with a diameter of the plug-type connection unit of less than 23 mm, the use of large line cross sections is made possible, which in turn enable high energy transmission values.

In a further configuration of the invention, the electrical plug-type contacts comprise at least three contacts, which are designed for maximum voltage and current intensity ranges of up to 630 V/16 A. In a further configuration, the electrical plug-type contacts comprise at least two additional contacts, which are designed for minimum voltage and current intensity ranges above 63 V/10 A. The additional contacts form auxiliary contacts. In addition, the electrical plug-type contacts comprise at least one PE conductor contact.

In a further configuration of the invention, each insulating body is encapsulated by injection molding with a protective sheath, which consists of an elastic plastics material and comprises a strain relief means surrounding the cable of the respective plug-type connection part. The protective sheath is formed integrally with the insulating body by virtue of it being injection-molded onto the already complete insulating body by means of an injection molding method. The strain relief means is provided by corresponding ring-like or sleeve-like sections of the protective sheath.

In a further configuration of the invention, each insulating body is provided with a sealing element surrounding the cable wires in an insertion region of the cable wires, said sealing element sealing off the rear receiving regions of the insulating body for the plug-type contacts. This configuration is advantageously suitable for miniaturized circular plug-type connection modules in which an outer diameter of the plug-type connection parts and of the locking sleeve is less than 23 mm. The configuration is preferably also suitable for transmitting high electrical voltages and current intensities, with the result that preferably, despite the miniaturization of the circular plug-type connection module, voltage and current intensity ranges up to 630 V/16 A can be transmitted. The described configuration can also be provided in the case of a multipole plug-type connection unit in which each plug-type connection part comprises a monolithic insulating body in which a plurality of electrical plug-type contacts are latched axially, without additional miniaturization and/or the transmission of high voltage and current intensity ranges being provided, however. By virtue of the described configuration, the rear insertion region of each insulating body in which the receiving regions for the axial insertion and latching of the electrical plug-type contacts are provided, is sealed off, with the result that casting compound which is required for the protective sheath of each insulating body cannot ingress into the receiving regions for the electrical plug-type contacts. Thus, the rear receiving regions for the electrical plug-type contacts in each insulating body remain free from casting material, with the result that each electrical plug-type contact is radially movable, limited to within certain tolerances, in the state in which it is latched in the receiving region of the insulating body. The axial latching forms a floating mounting arrangement for the electrical plug-type contacts since said electrical plug-type contacts can move in particular in the radial direction within certain limits within the receiving regions of each insulating body. This floating mounting arrangement and the limited movability enable a secure plug-type connection between the electrical plug-type contacts when the two insulating bodies are plugged together. In addition, by virtue of this configuration, each cable wire is held in the region of the rear end side of the associated insulating body with a defined alignment and positioning by means of the corresponding sealing element, with the result that the respective cable wire, together with the electrical plug-type contact which is fastened on the end side in particular by means of crimping, is aligned substantially coaxially within the respective receiving region of the associated insulating body. The respective sealing element for each of the two insulating bodies is preferably disk-shaped or plate-shaped and has plug-type profiled portions which are matched to the cross sections of the receiving regions of the respective insulating body and which can be plugged onto the corresponding rear end side of the insulating body in a force-fitting manner. Alternatively or in addition, provision is made for the sealing element to be adhesively bonded to the end side of the insulating body or for the sealing element to be secured on the rear end side of the respective insulating body in a form-fitting manner by means of the protective sheath for the insulating body being injection-molded on the outside thereof. The sealing element is produced as an integral plastics component part, preferably from the same material as the associated insulating body. Alternatively, it is possible to produce the corresponding sealing element from an elastomer or a thermoplastic elastomer.

In a further configuration of the invention, an outer jacket of each insulating body is provided with profiled portions for achieving an additional form-fitting connection for the protective sheath applied by injection molding. As a result, in addition to a corresponding cohesive connection between the protective sheath and the insulating body, a form-fitting connection is also achieved.

In a further configuration of the invention, a reverse rotation prevention means which is provided on the associated insulating body is assigned to the locking sleeve. The reverse rotation protection means prevents unintentional reverse rotation of the locking sleeve out of the locked state into the release state, in which the plug-type connection between the plug-type connection parts can be separated.

In a further configuration of the invention, the reverse rotation prevention means is embodied as a separate spring component part or as a spring lug integrally formed on the insulating body. Both variants have the same function. If the reverse rotation prevention means is embodied as a separate spring component part, the insulating body needs to have corresponding cutouts or receptacles, into which the spring component part can be inserted.

In a further configuration of the invention, the plug-type connection parts and the locking sleeve are configured as a circular plug-type connection, wherein the outer contours of the plug-type connection parts and of the locking sleeve are at least largely aligned with one another in the plugged-together state. As a result, a substantially cylindrical circular plug-type connection is provided in the plugged-together state of the plug-type connection parts and the locking sleeve.

In a further configuration of the invention, the plug-type connection parts are configured as a male connector/female connector combination, as a male elbow connector/female elbow connector combination, as couplings or as bushings. As a result, the plug-type connection unit can be designed for different use purposes. In particular, attachment or screw-in couplings or bushings are provided as couplings or bushings.

Further advantages and features, of the invention can be gleaned from the claims and from the description below relating to a preferred exemplary embodiment of the invention, which is illustrated by way of the drawings.

DETAILED DESCRIPTION

Figure 1:
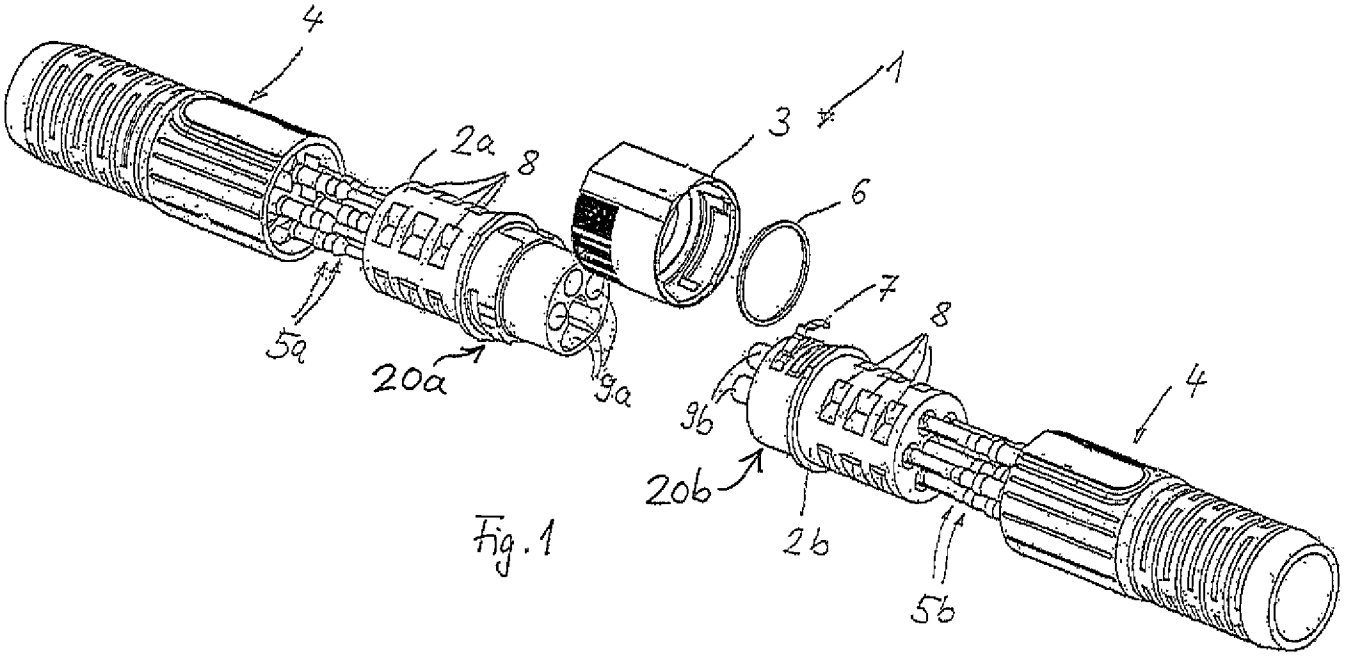
FIG. 1 shows an exploded illustration of an embodiment of a plug-type connection unit according to the invention.
Figure 2:
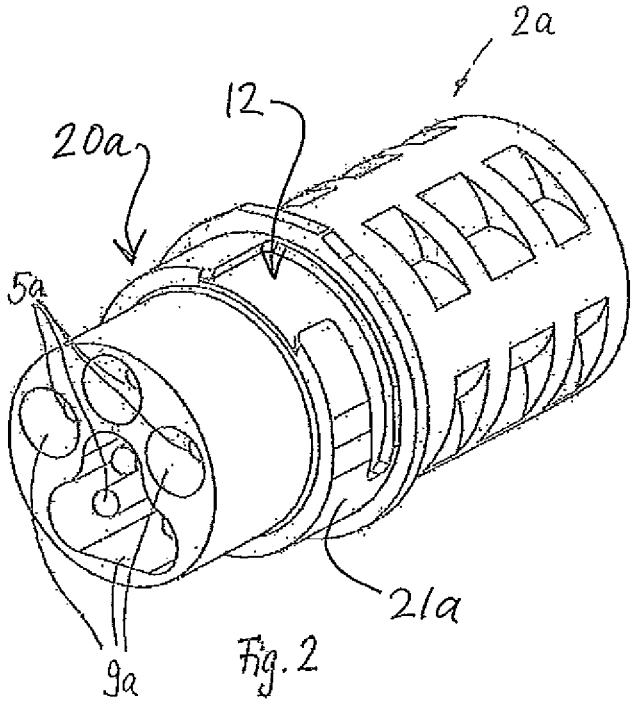
FIG. 2 shows a plug-type connection part in the form of a male connector of the plug-type connection unit shown in FIG. 1, but without protective sheath.
Figure 3:
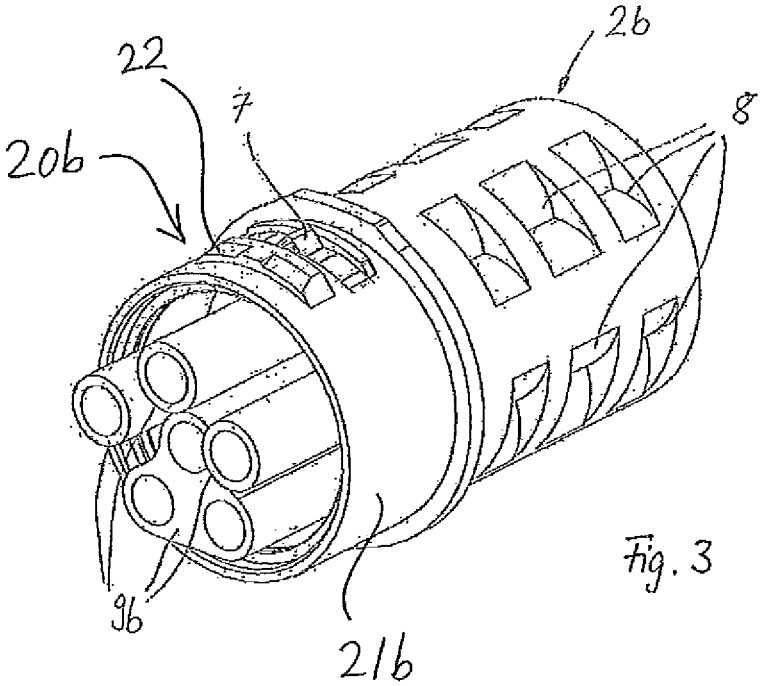
FIG. 3 shows a plug-type connection part in the form of a female connector which is complementary to the plug-type connection part shown in FIG. 2.
Figure 4:
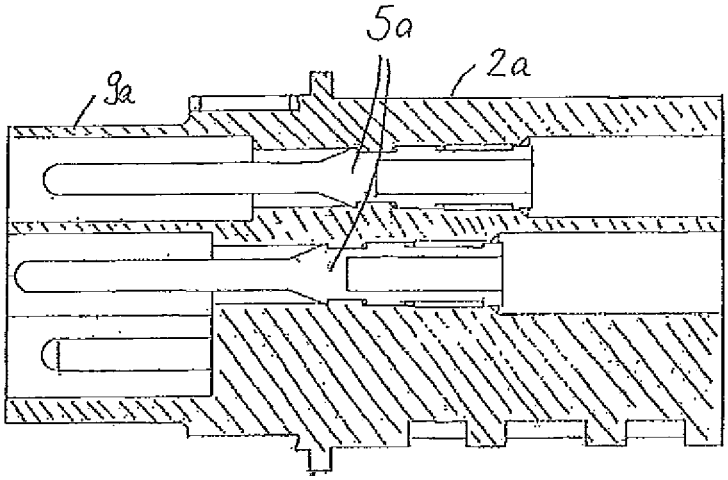
FIG. 4 shows a longitudinal sectional illustration of the plug-type connection part shown in FIG. 2.

A multipole plug-type connection unit for three-phase AC systems as shown in FIGS. 1 to 11 is assembled from a first plug-type connection part 2*a*, 4 embodied as a male connector, from a second plug-type connection part 2*b*, 4 embodied as a female connector and from a locking sleeve 3, which is connected nondetachably to the plug-type connection part 2*b*, 4 embodied as a female connector. The multipole plug-type connection unit is provided for signal and energy transmission between a machine tool and a control device or switchgear cabinet. The plug-type connection unit is embodied in miniaturized form and, in the plugged-together state shown in FIGS. 5 and 8 to 11, has a diameter of approximately 21 mm. Preferably, the diameter of the plug-type connection unit is less than 23 mm and, in a preferred embodiment, is 20.5 mm. Each plug-type connection part includes a monolithic insulating body 2*a*, 2*b*, a specific number of metallic, electrical plug-type contacts 5*a*, 5*b* and a protective sheath 4 which has been applied by injection molding and which is provided in each case with a strain relief means 11, applied by injection molding, for a cable harness of cables, which are connected with their connecting litz wires to the metallic, electrical plug-type contacts 5*a*, 5*b*. One monolithic insulating body 2*b* is embodied as a female connector. The other monolithic insulating body 2*a* is embodied as a male connector. Receptacles for axially and mechanically latching therein a total of six electrical plug-type contacts 5*a*, 5*b*, which are embodied as circular plug-in pins, are provided in each insulating body 2*a*, 2*b*. The plug-type contacts 5*a*, which are also referred to as contact pins, are embodied as male connector pins. The electrical plug-type contacts 5*b*, which can likewise be referred to as contact pins are embodied as female-connector or sleeve-shaped contact pins. The corresponding receptacles in the respective insulating body 2*a*, 2*b* are profiled in such a way that the contact pins 5*a*, 5*b* can be pushed in axially from a rear side of the respective insulating body 2*a*, 2*b* and can latch in a form-fitting manner necessarily into the receptacles in the function position of said contact pins. This can be seen easily from FIGS. 4 and 5. Each monolithic insulating body 2*a*, 2*b* is produced from a plastics material, preferably from polyamide.

Three of the plug-type contacts 5*a*, 5*b* in each insulating body 2*a*, 2*b* are designed for energy transmission of up to 630 volts/16 amperes. Two further plug-type contacts in the form of contact pins of each insulating body 2*a*, 2*b* are configured as auxiliary contacts for a minimum voltage of 63 volts and a minimum current intensity of 10 amperes. In addition, the six plug-type contacts 5*a*, 5*b* of each insulating body 2*a*, 2*b* each comprise a PE conductor contact. The three plug-type contacts, which are configured for a maximum of 630 volts/16 amperes, are provided for the connection of copper lines of corresponding connection cables, which have a line cross section of up to 2.5 $mm^2$.

Each plug-type connection part is provided with a protective sheath 4, which is applied to the respective insulating body 2*a*, 2*b* by an injection-molding method and which comprises the strain relief means 11 for the cable harnesses which emerge from the respective electrical plug-type contacts 5*a*, 5*b*. The protective sheath 4 is produced from a suitable elastic and flexible plastics material which has good adhesion and good haptic properties. In order to improve the cohesive connection by means of the injection-molding method between the insulating bodies 2*a*, 2*b* and the protective sheath 4, an outer jacket of each insulating body is provided with profiled portions in the form of depressions 8 in a cylindrical connecting section, with it being possible for the injection-molding material of the protective sheath 4 to flow into said depressions in a form-fitting manner during the production process. The respective protective sheath 4 ends in the region of a ring flange, not described in anymore detail, of each insulating body 2*a*, 2*b*, after which, when viewed in the plug-in direction, a respective end connecting or connection section 20*a*, 20*b* of each insulating body 2*a*, 2*b* is attached. Each connecting or connection section 20*a*, 20*b* has an axial plug-type connection section 9*a*, 9*b* and a circumferential section with an outer contour 21*a*, 21*b*, which is provided for the axial locking of the two plug-type connection parts to one another via the locking sleeve 3 as soon as the two insulating bodies 2*a*, 2*b* are plugged together. One plug-type connection section 9*a* of the insulating body 2*a* is in the form of a male connector. The other plug-type connection section 9*b* of the insulating body 2*b* is in the form of a female connector. For this purpose, the female connector form of the insulating body 2*b* has three plug-type sleeves which protrude axially separately with respect to one another, and a plug-type, sleeve-shaped triple connector, in which three plug-type contacts (female connector contacts) are disposed and which is embodied as a monolithic assembly. The plug-type sleeves and the sleeve-shaped triple connector are in the form of integral protrusions of the monolithic insulating body 2*b*. Corresponding to this, the plug-type connection section 9*a* (in the form of a female connector) of the insulating body 2*a* has three cylindrical receptacles, into which the cylindrical plug-type sleeves of the plug-type connection sections 9*b* can be plugged. In addition, a receptacle matched to the dome-like triple male connector of the insulating body 2*b* is provided, into which receptacle the triple plug-type dome can be plugged axially. The plug-type sleeves of the plug-type connection sections 9*b* also form simple cylindrical plug-type domes. The axial plug-in depth of the plug-type connection sections of the two insulating bodies 2*a*, 2*b* is selected to be so great that bending or tipping is prevented in the region of the plug-type connection in the plugged-together state of the insulating bodies 2*a*, 2*b*. As can be seen from FIGS. 4 to 9, in each case the metallic electrical plug-type contacts 5*a*, 5*b* are aligned in the corresponding plug-type connection sections, which are produced from the plastics material of the respective monolithic insulating body 2*a*, 2*b*, said metallic electrical plug-type contacts 5*a*, 5*b* necessarily being brought into electrical contact with one another when the insulating bodies 2*a*, 2*b* are plugged together. The corresponding plug-type profiled portions of the plug-type connection sections 9*a*, 9*b* are configured with a precise fit such that, after the plugging-together operation, a fit without play and with high contact forces is insured.

Figure 11:
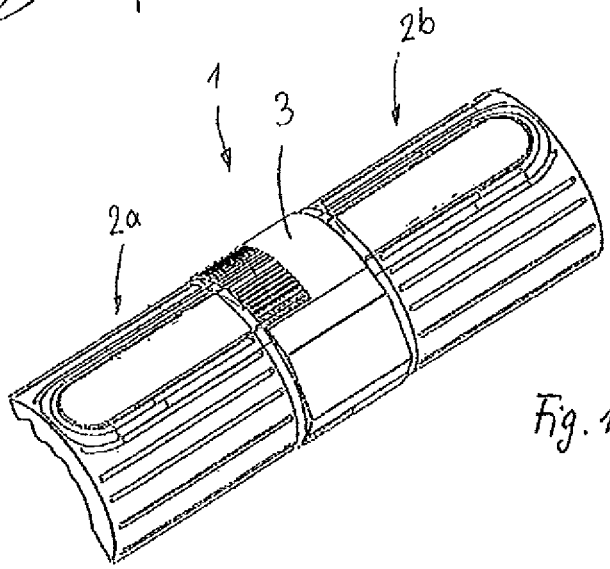
FIG. 11 shows the plug-type connection unit shown in FIG. 10 in the plugged and locked state.
Figure 12:
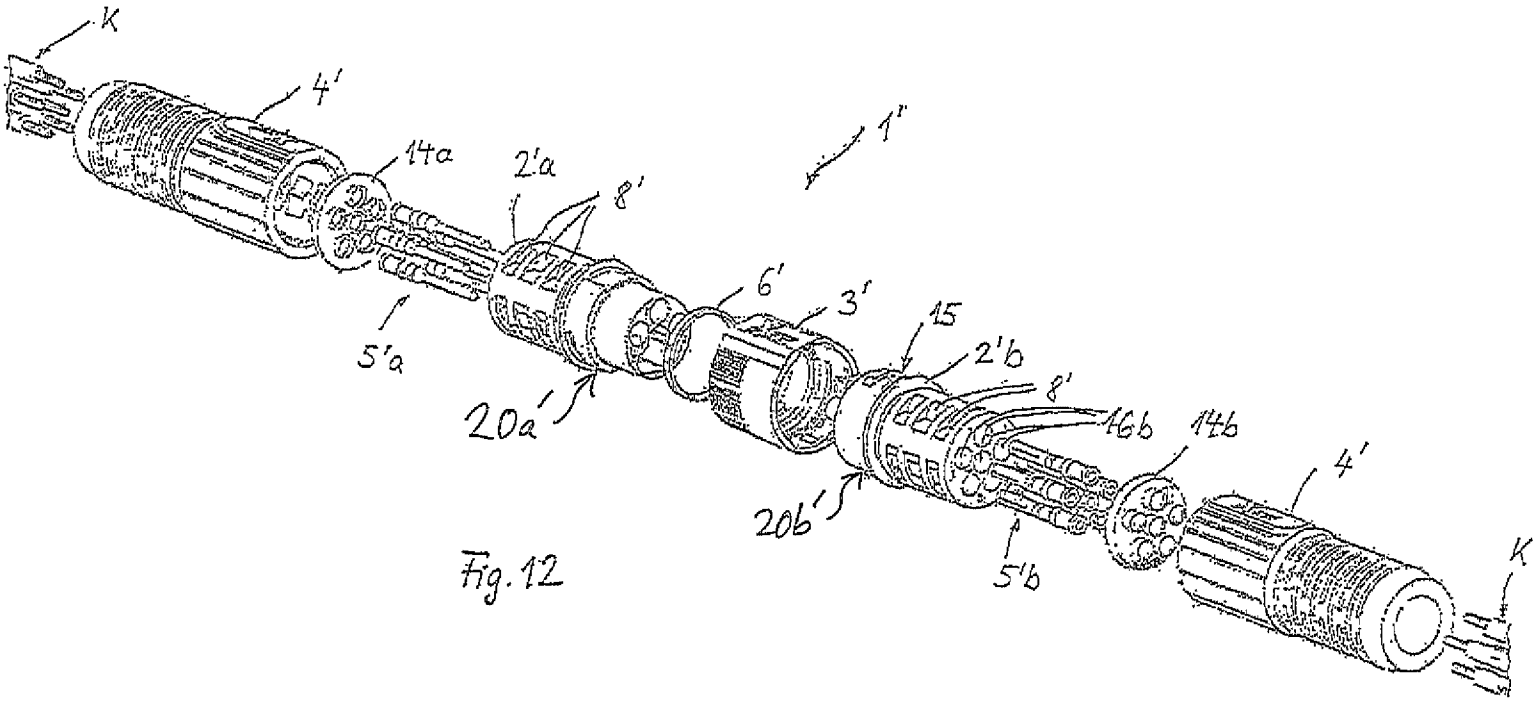
FIG. 12 shows an exploded illustration of a further embodiment of a plug-type connection unit according to the invention.
Figure 13:
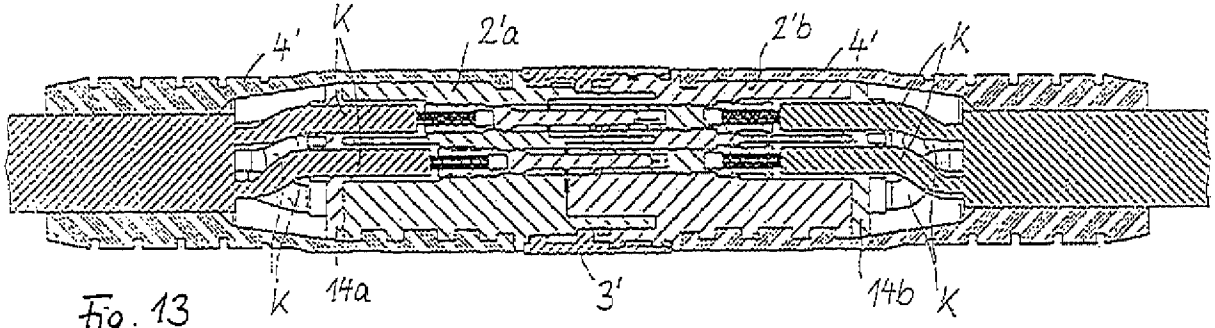
FIG. 13 shows an enlarged longitudinal sectional illustration of the plug-type connection unit shown in FIG. 12 in the plugged-together functional state.
Figure 14:
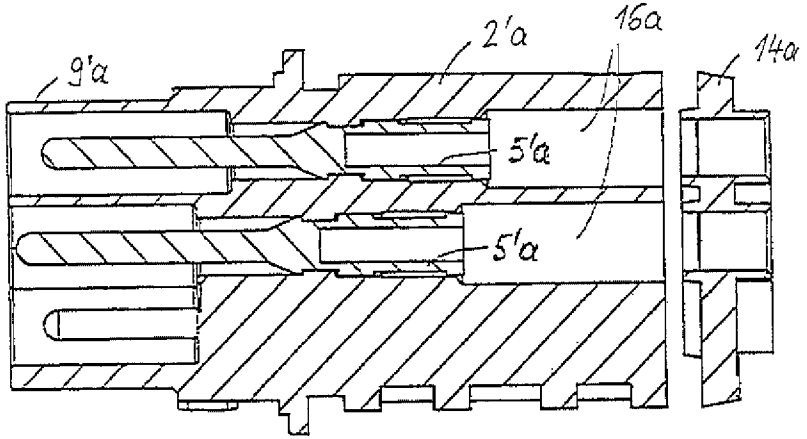
FIG. 14 shows a plug-type connection part in the form of a male connector of the plug-type connection unit shown in FIG. 13, without the protective sheath and without cable wires.
Figure 15:
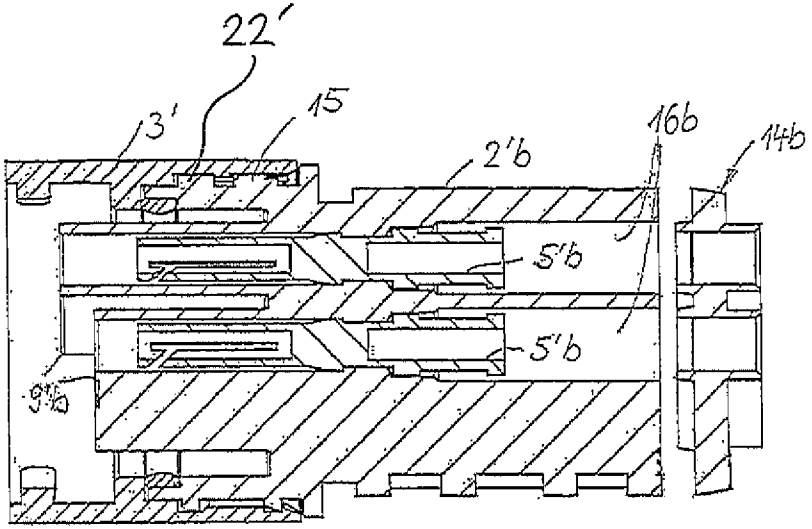
FIG. 15 shows the plug-type connection part, corresponding to the plug-type connection part shown in FIG. 14, of the plug-type connection unit shown in FIGS. 12 and 13 with the locking sleeve, but without the protective sheath.
Figure 16:
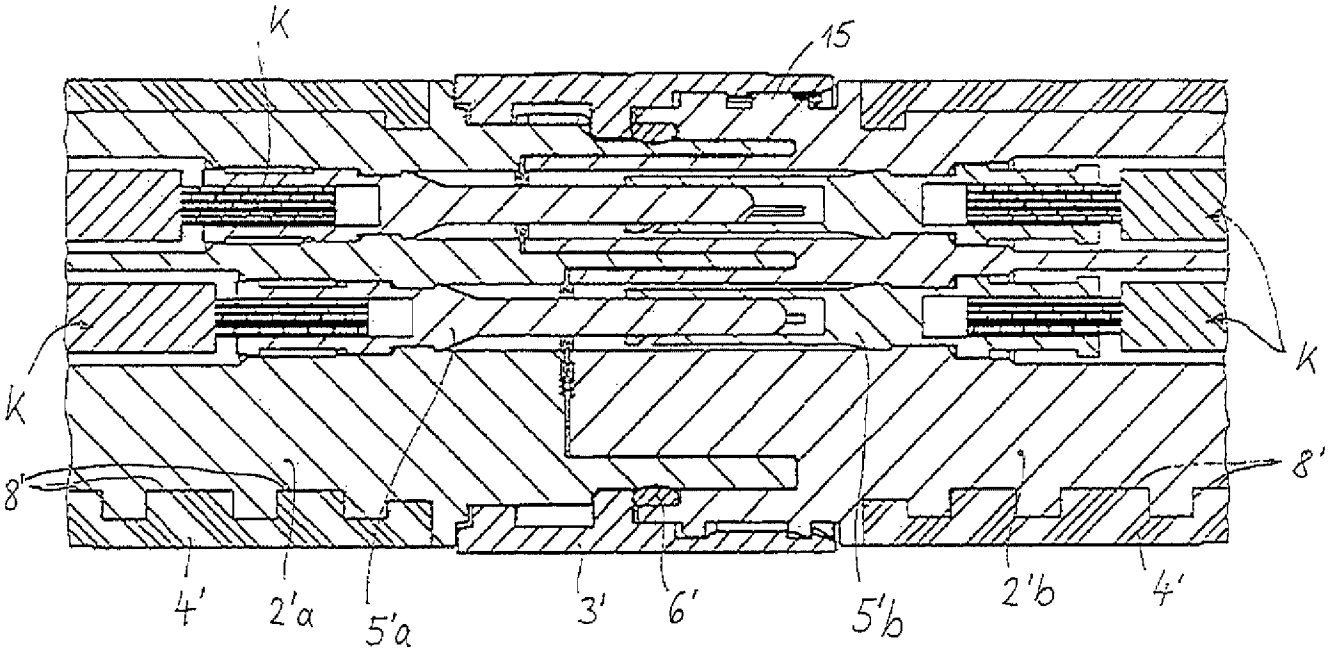
FIG. 16 shows an enlarged illustration of a detail of the plug-type connection unit shown in FIG. 13.

In order to prevent the plugged-together insulating bodies 2*a*, 2*b* from becoming detached from one another again, the locking sleeve 3 is provided, which locking sleeve is held nondetachably, but with the possibility of rotary movement, on the insulating body 2*b*. For this purpose, the locking sleeve 3 is latched in a simple manner onto a corresponding profiled portion or projection 22 on the outer circumference of the end connection section 21*b* of the insulating body 2*b*. In addition, a small leaf spring 7 is provided, which acts as reverse rotation prevention means for the locking sleeve 3 in the locked state of the plug-type connection parts 2*a*, 2*b*, 4 with respect to one another (FIG. 11). For the form-fitting axial locking of the two plug-type connection parts 2*a*, 2*b*, 4 with one another, the locking sleeve 3 is provided with cams 13, which enter axially into bayonette-like cutouts 12 (FIGS. 2 and 6) in the other insulating body 2*a* and, by virtue of being rotated, achieve the desired axial form-fitting connection.

Figure 5:
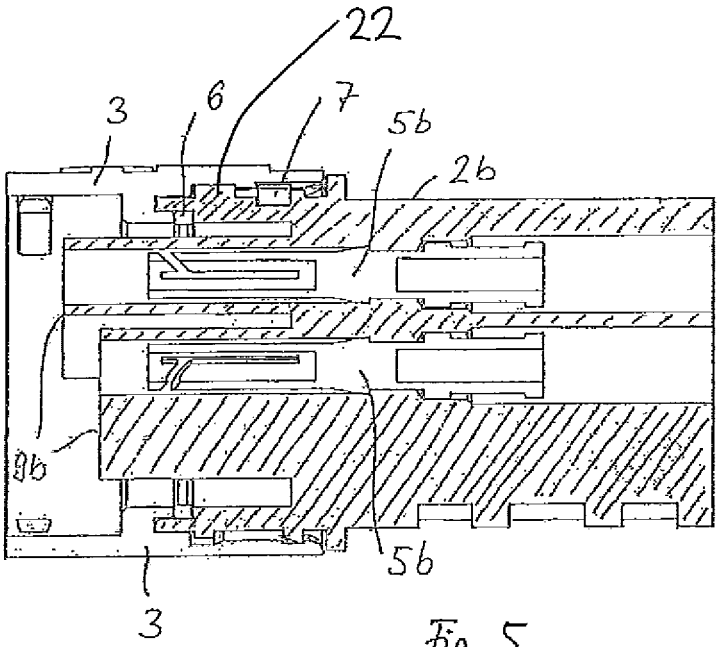
FIG. 5 shows a longitudinal sectional illustration of the plug-type connection part shown in FIG. 3, with the locking sleeve fitted.
Figure 6:
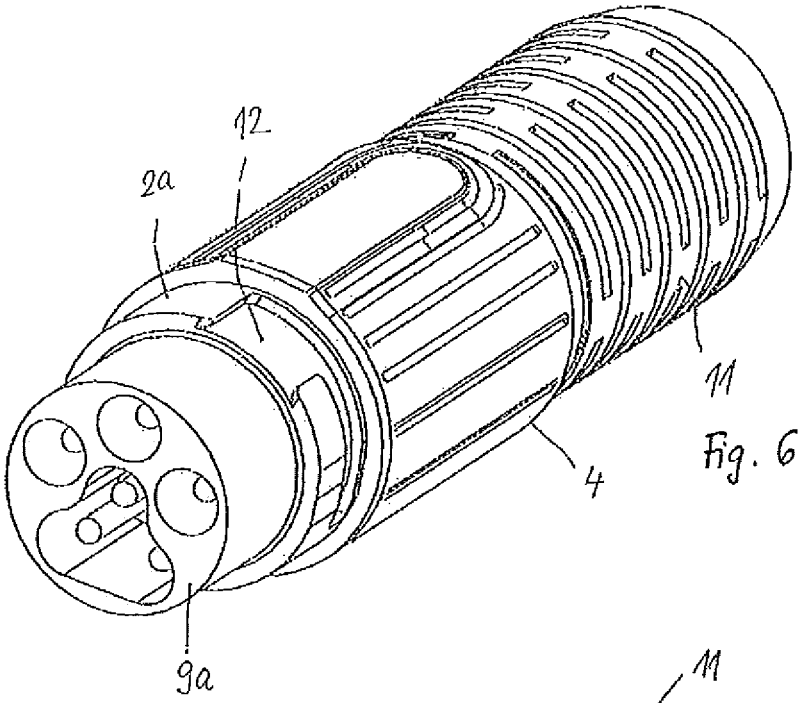
FIG. 6 shows the plug-type connection part embodied as a male connector as shown in FIG. 2, but with the protective sheath injection-molded on, FIG. 7 shows the plug-type connection part embodied as a female connector as shown in FIG. 3, but encapsulated with the protective sheath by injection molding and with the locking sleeve fitted.
Figure 7:
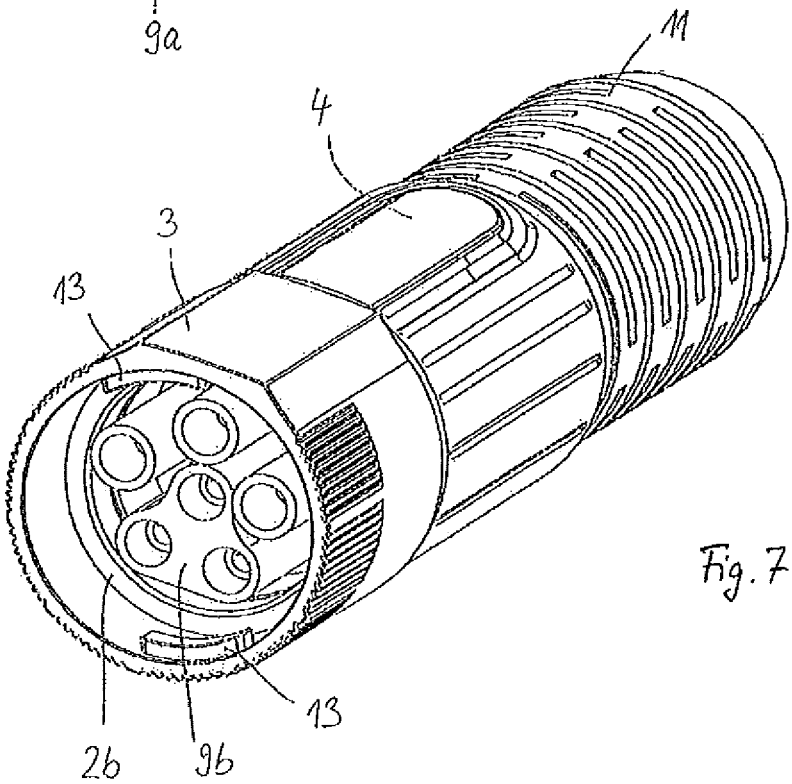
Figure 8:
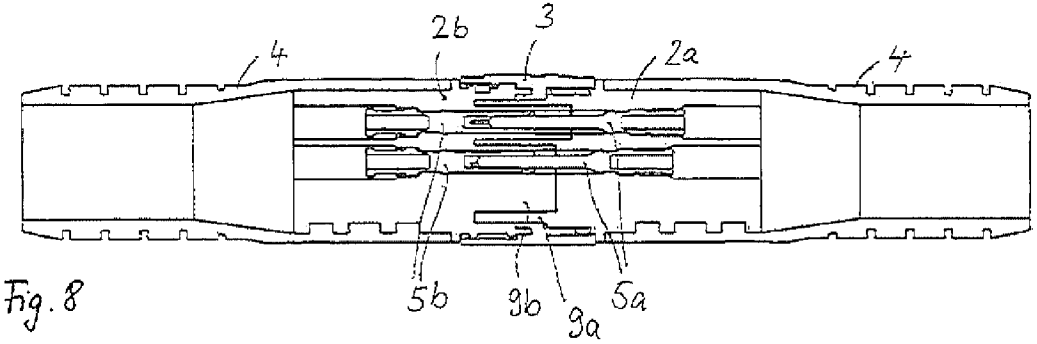
FIG. 8 shows a longitudinal section through the plug-type connection unit shown in FIG. 1.
Figure 9:
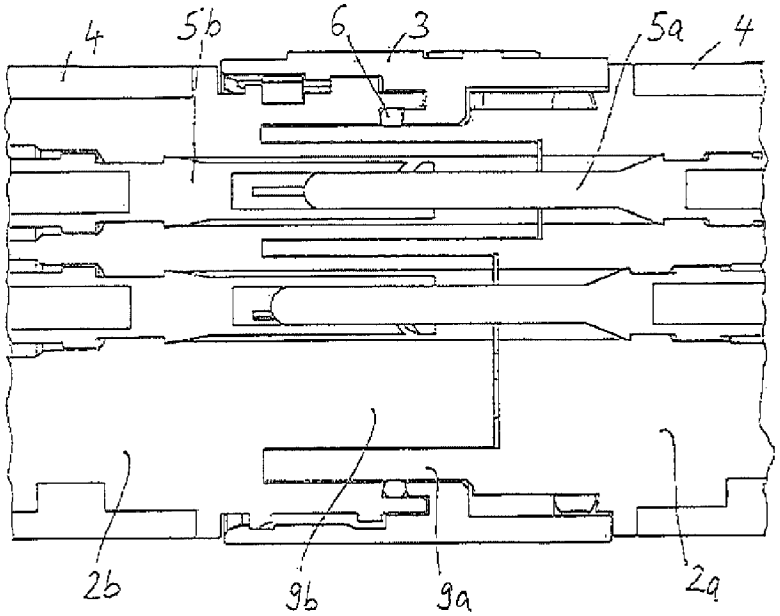
FIG. 9 shows an enlarged illustration of a detail of the longitudinal section shown in FIG. 8.

In order to seal the plug-type connection parts 2*a*, 2*b*, 4 with one another in the plugged-together state, an additional O ring seal 6 is provided in the region of the locking sleeve 3, which O ring seal is positioned as shown in the illustration shown in FIGS. 5 and 9, in the plugged-together state. The plug-type connection unit 1 is overall dust-tight and water-tight and meets the protection class IP65.

Figure 10:
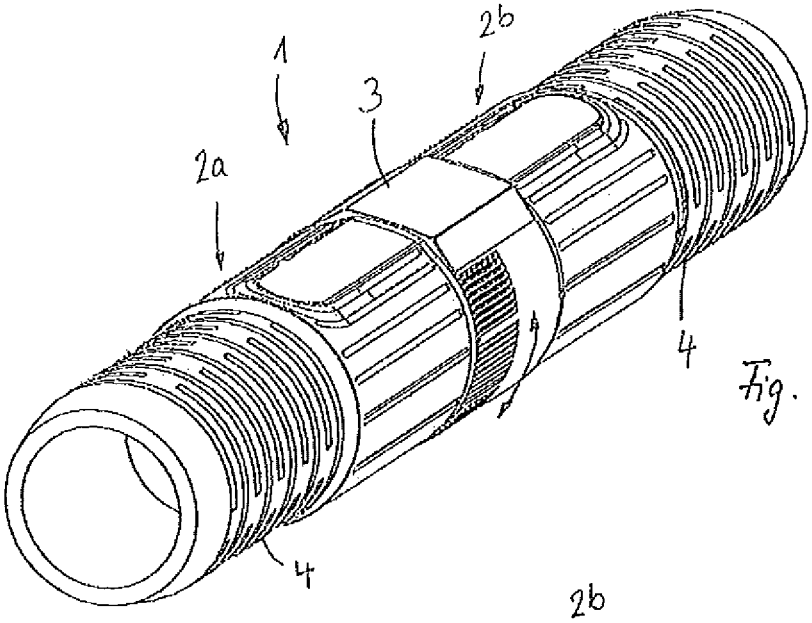
FIG. 10 shows the plug-type connection unit shown in FIG. 1 in the plugged but unlocked state.

An unlocked or locked state of the plug-type connection unit 1 can easily be seen by an observer from the outside. As soon as the plug-type connection parts 2*a*, 2*b*, 4 of the plug-type connection unit 1 are plugged together axially, but not yet locked, planar surface sections of the insulating bodies 2*a*, 2*b* and of the locking sleeve 3 align with one another, as can be seen in FIG. 10. The planar surface sections are increased radially towards the plug-in axis of the plug-type connection unit on all three component parts, as can be seen from FIG. 10. By virtue of simply rotating the locking sleeve 3, the plug-type connection unit is brought into its axially locked state, in which the cams 13 arranged on the inside on the locking sleeve 3 enter into pockets, running in the circumferential direction, of the cutouts 12. By virtue of this rotation, the planar surface section of the locking sleeve 3 is offset in the circumferential direction relative to the planar surface sections of the adjacent insulating bodies 2*a*, 2*b* (FIG. 11). It can thus be seen by an observer that the plug-type connection unit 1 is in its locked state.

The multipole plug-type connection unit shown in FIGS. 12 to 16 substantially corresponds to the plug-type connection unit described in detail with reference to FIGS. 1 to 11 previously. In order to avoid repetition, therefore, reference is made to the statements in respect of the plug-type connection unit shown in FIGS. 1 to 11. Functionally identical component parts and sections of the plug-type connection unit shown in FIGS. 12 to 16 have the same reference symbols, but with the addition of a '. In the embodiment shown in FIGS. 12 to 16, corresponding connection cables for the two plug-type connection parts 2'*a*, 2'*b* are additionally provided, which are provided with a plurality of cable wires K for making contact with in each case one electrical plug-type contact 5'*a*, 5'*b*. The connection of the cable wires K to the corresponding electrical plug-type contacts 5'*a*, 5'*b* is performed in the example illustrated by means of crimping. The connection, and contact-making, of the connection cables to the plug-type connection unit in accordance with FIGS. 1 to 11 is performed in the same way, although this is not illustrated in said figures.

Details will be given below of the differences between the plug-type connection unit shown in FIGS. 12 to 16 and the plug-type connection unit shown in FIGS. 1 to 11.

In the exemplary embodiment shown in FIGS. 12 to 16, a latching lug combination 15 is provided instead of a separate small leaf spring as the reverse rotation prevention means for the locking sleeve 3', wherein corresponding latching lugs are provided on the locking sleeve 3' and on the plug-type connection part 2'*b*. The corresponding latching lugs are formed integrally on the locking sleeve 3' or on the insulating body of the plug-type connection part 2'*b*.

Both plug-type connection parts each have a monolithic insulating body 2'*a*, 2'*b*, which are each provided with in total six receiving regions 16*a*, 16*b*, which are open towards a rear end side, when viewed in the plug-type connection direction, of the respective insulating body 2'*a*, 2'*b*. The receiving regions 16*a*, 16*b* are used for the axial insertion of the corresponding female connector or male connector electrical plug-type contacts 5'*a*, 5'*b* from the rear, in order to enable the axial latching-in within the respective insulating body 2'*a*, 2'*b*. Each electrical plug-type contact 5'*a*, 5'*b* is connected, by means of crimping, in each case to a cable wire K of a cable harness of the respective electrical connection cable. Each of the cable wires K has previously been drawn through a corresponding cutout in a sealing disk 14*a*, 14*b* acting as sealing element. The cutouts are matched to the respective insulating sheath of the corresponding cable wires in such a way that each cutout surrounds the respective cable wire K in sealing fashion once said cable wire has been drawn through the sealing disk 14*a*, 14*b*. For this purpose, the cutouts each have a circular cross section. The sealing disk 14*a*, 14*b* is additionally provided with an integrally formed, ring-shaped thickened portion on both end sides in the rim region of each cutout, which thickened portion acts as plug-type profiled portion for plugging into the corresponding receiving regions 16*a*, 16*b*. The thickened portions in the form of ring webs running around the cutouts are matched in terms of their dimensions to the cross sections of the receiving regions 16*a*, 16*b* in such a way that they can be plugged axially in a force-fitting manner, from the respective rear end side of the respective insulating body 2'*a*, 2'*b*, into the receiving regions 16*a*, 16*b* until the planar end face of the respective sealing disk 14*a*, 14*b* bears flush against the end side of the corresponding insulating body 2'*a*, 2'*b*. It can be seen from FIG. 13 that, as a result, the cable wires K, which have been connected with their end-side litz wires to the corresponding plug-type contacts 5'*a*, 5'*b*, are positioned so as to be substantially coaxially aligned with respect to the receiving regions 16*a*, 16*b* of the insulating body 2'*a*, 2'*b* by means of the sealing disk 14*a*, 14*b*, which acts as rear stopper for the receiving regions 16*a*, 16*b* of the insulating body 2'*a*, 2'*b*.

After this preassembly, the encapsulation by injection molding with the protective sheath 4' is performed by means of a suitable plastics material, preferably a thermoplastic elastomer. By virtue of the fact that the sealing disks 14*a*, 14*b* rest in sealing fashion on the respective rear end side of the insulating body 2'*a*, 2'*b*, no casting compound from this protective sheath 4' can enter into the receiving regions 16*a*, 16*b* of the insulating bodies 2'*a*, 2'*b*. Instead, a free space remains between the cable wires K and the inner walls of the receiving regions 16*a*, 16*b*, which free space enables a certain amount of radial play and therefore a certain degree of movability of the cable wires K within the receiving regions 16*a*, 16*b*. Owing to the fact that the electrical plug-type contacts 5'*a*, 5'*b* are latched axially only in a central region, the electrical plug-type contacts 5'*a*, 5'*b* can position themselves at an angle around the mounting arrangement in the region of the latchings within certain tolerances and yield. As a result, a subsequent plug-type connection procedure with the corresponding plug-type connection part is facilitated. This is because the plug-type contacts 5'*a*, 5'*b* in the form of female connectors and male connectors which are intended to be connected to one another in pairs can be aligned with one another in a limited manner, as a result of which the manually effected axial plug-in operation is facilitated. The sealing disk 14*a*, 14*b* is held firstly in a force-fitting manner owing to the plug-type connections of the ring webs in the region of the cutouts with the receiving regions 16*a*, 16*b* and secondly in a form-fitting and/or cohesive manner by means of the encapsulation by injection molding with the protective sheath 4' on the respective rear end side of the insulating body 2'*a*, 2'*b*.

The invention claimed is:

1. A multipole plug-type connection unit for three-phase AC systems comprising two plug-type connection parts which are complementary to one another for plugging one inside the other without bending and comprising a locking sleeve, the locking sleeve securing the plug-type connection parts axially against one another in a plugged-together state, each plug-type connection part being designed as a single-piece, monolithic insulating body in which a plurality of electrical plug-type contacts are latched axially, each single-piece, monolithic insulating body having a connection section, the respective connection sections of the single-piece, monolithic insulating bodies being disposed in adjacent relation with one another in the plugged-together state, each said connection section having an outer contour configured and disposed to directly engage with the locking sleeve, an outer diameter of the plug-type connection parts and of the locking sleeve being less than 23 mm, and the plug-type connection unit being designed to transmit voltage and current intensity ranges of up to 630 volts/16 amperes (630 V/16 A).

2. The multipole plug-type connection unit as claimed in claim 1, wherein the plug-type connection unit has a dust-tight and water-tight design in accordance with protection class IP65.

3. The multipole plug-type connection unit as claimed in claim 1, wherein electrical cable wires of a cable having a wire cross section of up to 2.5 $mm^2$ are connected to the electrical plug-type contacts.

4. The multipole plug-type connection unit as claimed in claim 3, wherein the electrical plug-type contacts comprise at least three contacts designed for maximum voltage and current intensity ranges of up to 630 V/16 A.

5. The multipole plug-type connection unit as claimed in claim 3, wherein the electrical plug-type contacts comprise at least two additional contacts designed for minimum voltage and current intensity ranges above 63 V/10 A.

6. The multipole plug-type connection unit as claimed in claim 1, wherein each single-piece, monolithic insulating body is encapsulated by injection molding with a protective sheath constructed of an elastic plastics material and comprising a strain relief configuration surrounding a cable of the corresponding plug-type connection part.

7. The multipole plug-type connection unit as claimed in claim 6, further including a sealing element disposed to surround respective cable wires of the cable of each plug-type connection part, each said sealing element sealing off a rear receiving region of the corresponding single-piece, monolithic insulating body.

8. The multipole plug-type connection unit as claimed in claim 6, wherein an outer jacket of each single-piece, monolithic insulating body is provided with profiled portions for achieving a form-fitting connection with the protective sheath applied to the corresponding single-piece, monolithic insulating body by injection molding.

9. The multipole plug-type connection unit as claimed in claim 1, wherein the locking sleeve is rotatably mounted on the plug-type connection parts and rotates in a first direction to lock the plug-type connection parts to one another, the plug-type connection unit further including an anti-rotation element disposed on one of the single-piece, monolithic insulating bodies to prevent rotation of the locking sleeve in a second direction of rotation opposite the first direction of rotation.

10. The multipole plug-type connection unit as claimed in claim 9, wherein the anti-rotation element comprises a separate spring component part separate from the one single-piece, monolithic insulating body or a lug integrally formed on the one single-piece, monolithic insulating body.

11. The multipole plug-type connection unit as claimed in claim 1, wherein said outer contour of each said connection section cooperatively engages and directly contacts said locking sleeve to secure said locking sleeve to said connection sections.

12. The multipole plug-type connection unit as claimed in claim 11, wherein said locking sleeve and said outer contour of one of said connection sections together define a cam arrangement disposed to secure said locking sleeve to said connection sections, said cam arrangement including a recess defined in one of said locking sleeve and said outer contour of said one connection section and a projection on the other of said locking sleeve and said outer contour of said one connection section, and said outer contour of the other of said connection sections defines thereon a projection which engages an interior of said locking sleeve to secure said locking sleeve to said connection sections.

13. The multipole plug-type connection unit as claimed in claim 1, wherein said outer contour of one of said connection sections defines thereon a projection which engages an interior of said locking sleeve to secure said locking sleeve thereto.

14. A multipole plug-type connection unit for three-phase AC systems, said connection unit defining a longitudinal axis and comprising:

a first plug-shaped connection part including a single-piece, monolithic insulating body and a plurality of electrical contacts disposed therein, said single-piece, monolithic insulating body having a connection section defining a terminal end thereof;

a second plug-shaped connection part including a single-piece, monolithic insulating body and a plurality of electrical contacts disposed therein, said single-piece, monolithic insulating body of said second plug-shaped connection part having a connection section defining a terminal end thereof, said connection sections having respective portions configured in a complementary manner with one another to permit insertion, in a direction substantially parallel to the axis, of said portion of said second plug-shaped connection part into said portion of said first plug-shaped connection part without bending to define a connected state of said first and second plug-shaped connection parts; and a locking sleeve disposed in surrounding relation with said connection sections of said first and second plug-shaped connection parts in the connected state and securing said first and second plug-shaped connection parts to one another in the connected state in the direction substantially parallel to the axis, said locking sleeve and said first and second plug-shaped connection parts in the connected state together defining an outer diameter of said connection unit of less than 23 mm, and each said connection section defines an outer contour configured to cooperatively engage and directly contact said locking sleeve to secure said locking sleeve to said connection sections.

15. The multipole plug-type connection unit as claimed in claim 14, wherein each said first and second plug-shaped connection part includes a protective sheath comprising plastic, said protective sheath being injection-molded over the respective said single-piece, monolithic insulating body so as to encapsulate at least part of same.

16. The multipole plug-type connection unit as claimed in claim 15, wherein each said protective sheath encapsulates the corresponding said single-piece, monolithic insulating body along a substantial portion of a total axial length thereof.

17. The multipole plug-type connection unit as claimed in claim 16, wherein each said protective sheath extends in the direction substantially parallel to the axis and terminates at said locking sleeve.

18. The multipole plug-type connection unit as claimed in claim 14, wherein said locking sleeve is rotatably mounted on said connection sections of said first and second plug-shaped connection parts and rotates in a first direction to lock said first and second plug-type connection parts to one another, said plug-type connection unit further including an anti-rotation element disposed on one of said single-piece, monolithic insulating bodies to prevent rotation of said locking sleeve in a second direction of rotation opposite the first direction of rotation.

19. The multipole plug-type connection unit as claimed in claim 18, wherein said locking sleeve and said outer contour of one of said connection sections together define a cam arrangement disposed to secure said locking sleeve to said connection sections, said cam arrangement including a recess defined in one of said locking sleeve and said one connection section and a projection on the other of said locking sleeve and said one connection section, and rotation of said locking sleeve in the first direction of rotation engages said projection within said recess to prevent detachment of said first and second plug-shaped connection parts from one another.

20. The multipole plug-type connection unit as claimed in claim 19, wherein said outer contour of the other of said connection sections defines thereon a projection which engages an interior of said locking sleeve to secure said locking sleeve to said connection sections.

21. The multipole plug-type connection unit as claimed in claim 14, wherein said outer contour of one of said connection sections defines thereon a projection which engages an interior of said locking sleeve to secure said locking sleeve thereto.

* * * * *